US009025979B2

(12) United States Patent
Sakurabayashi

(10) Patent No.: US 9,025,979 B2
(45) Date of Patent: May 5, 2015

(54) IMAGE FORMING APPARATUS AND BIAS POWER SUPPLY APPARATUS AND METHOD

(71) Applicant: Fuji Xerox Co., Ltd., Minato-ku, Tokyo (JP)

(72) Inventor: Yuya Sakurabayashi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 31 days.

(21) Appl. No.: 13/748,129

(22) Filed: Jan. 23, 2013

(65) Prior Publication Data

US 2014/0086606 A1 Mar. 27, 2014

(30) Foreign Application Priority Data

Sep. 25, 2012 (JP) ..... 2012-211370

(51) Int. Cl.

| | |
|---|---|
| ***G03G 15/06*** | (2006.01) |
| ***G05F 5/00*** | (2006.01) |
| ***G03G 15/00*** | (2006.01) |
| ***G03G 15/08*** | (2006.01) |

(52) U.S. Cl.

CPC *G05F 5/00* (2013.01); *G03G 15/80* (2013.01); *G03G 15/0803* (2013.01); *G03G 2215/0129* (2013.01)

(58) Field of Classification Search

CPC ..... G03G 15/065; G03G 15/5004
USPC ..... 323/301; 363/34, 95; 399/55, 88
See application file for complete search history.

(56) References Cited

U.S. PATENT DOCUMENTS

| | | | | |
|---|---|---|---|---|
| 4,797,803 | A * | 1/1989 | Carroll | 363/95 |
| 6,703,796 | B2 * | 3/2004 | Che-Chen et al. | 315/291 |
| 6,889,017 | B2 * | 5/2005 | Park et al. | 399/55 |
| 7,315,464 | B2 * | 1/2008 | Sawada et al. | 363/159 |
| 7,446,512 | B2 * | 11/2008 | Nishihara et al. | 323/233 |
| 7,952,301 | B2 * | 5/2011 | Biegel | 315/291 |
| 8,125,804 | B2 * | 2/2012 | He et al. | 363/67 |
| 8,625,314 | B2 * | 1/2014 | Hosotani et al. | 363/22 |

FOREIGN PATENT DOCUMENTS

| | | |
|---|---|---|
| JP | 6-197542 A | 7/1994 |
| JP | 3228298 B2 | 11/2001 |

* cited by examiner

*Primary Examiner* — Clayton E Laballe
*Assistant Examiner* — Trevor J Bervik
(74) *Attorney, Agent, or Firm* — Sughrue Mion, PLLC

(57) ABSTRACT

An image forming apparatus includes an image carrier and the following elements. A charging unit charges the image carrier. An exposure unit exposes the charged image carrier to light and forms an electrostatic latent image. A developing unit generates a developing electric field and develops the electrostatic latent image. A transfer unit transfers the developed image. A controller outputs an AC setting signal. The developing unit includes a bias power supply source having the following elements. An output transformer includes a primary winding and a secondary winding. A switching circuit supplies a current to the primary winding. A current control circuit includes first impedance and second impedance. The first impedance is set when the AC voltage has a first frequency and the second impedance is set when the AC voltage has a second frequency, thereby controlling a current flowing between the primary winding and the switching circuit.

8 Claims, 7 Drawing Sheets

IMAGE FORMING APPARATUS AND BIAS POWER SUPPLY APPARATUS AND METHOD

CROSS-REFERENCE TO RELATED APPLICATIONS

This application is based on and claims priority under 35 USC 119 from Japanese Patent Application No. 2012-211370 filed Sep. 25, 2012.

BACKGROUND

Technical Field

The present invention relates to an image forming apparatus and a bias power supply apparatus and method.

SUMMARY

According to an aspect of the invention, there is provided an image forming apparatus including: an image carrier; a charging unit that charges the image carrier; an exposure unit that exposes the image carrier charged by the charging unit to light and that forms an electrostatic latent image on the image carrier; a developing unit that generates a developing electric field in which an AC voltage and a DC voltage are superposed on each other and that develops the electrostatic latent image formed on the image carrier so as to form a developed image; a transfer unit that transfers the developed image onto a transfer subject; and a controller that outputs an AC setting signal for setting a frequency of the AC voltage of the developing electric field generated by the developing unit. The developing unit includes a bias power supply source. The bias power supply source includes the following elements. An output transformer includes a primary winding and a secondary winding, the AC voltage being output from the secondary winding. A switching circuit supplies a current to the primary winding of the output transformer by performing switching on the basis of the AC setting signal output from the controller. A current control circuit is disposed between the primary winding of the output transformer and the switching circuit and includes first impedance and second impedance, the second impedance being greater than the first impedance. The first impedance is set when the frequency of the AC voltage is a first frequency and the second impedance is set when the frequency of the AC voltage is a second frequency, the second frequency being lower than the first frequency, thereby controlling a current flowing between the primary winding of the output transformer and the switching circuit.

BRIEF DESCRIPTION OF THE DRAWINGS

Exemplary embodiments of the present invention will be described in detail based on the following figures, wherein.

DETAILED DESCRIPTION

First Exemplary Embodiment

Image Forming Apparatus 1

Figure 1:
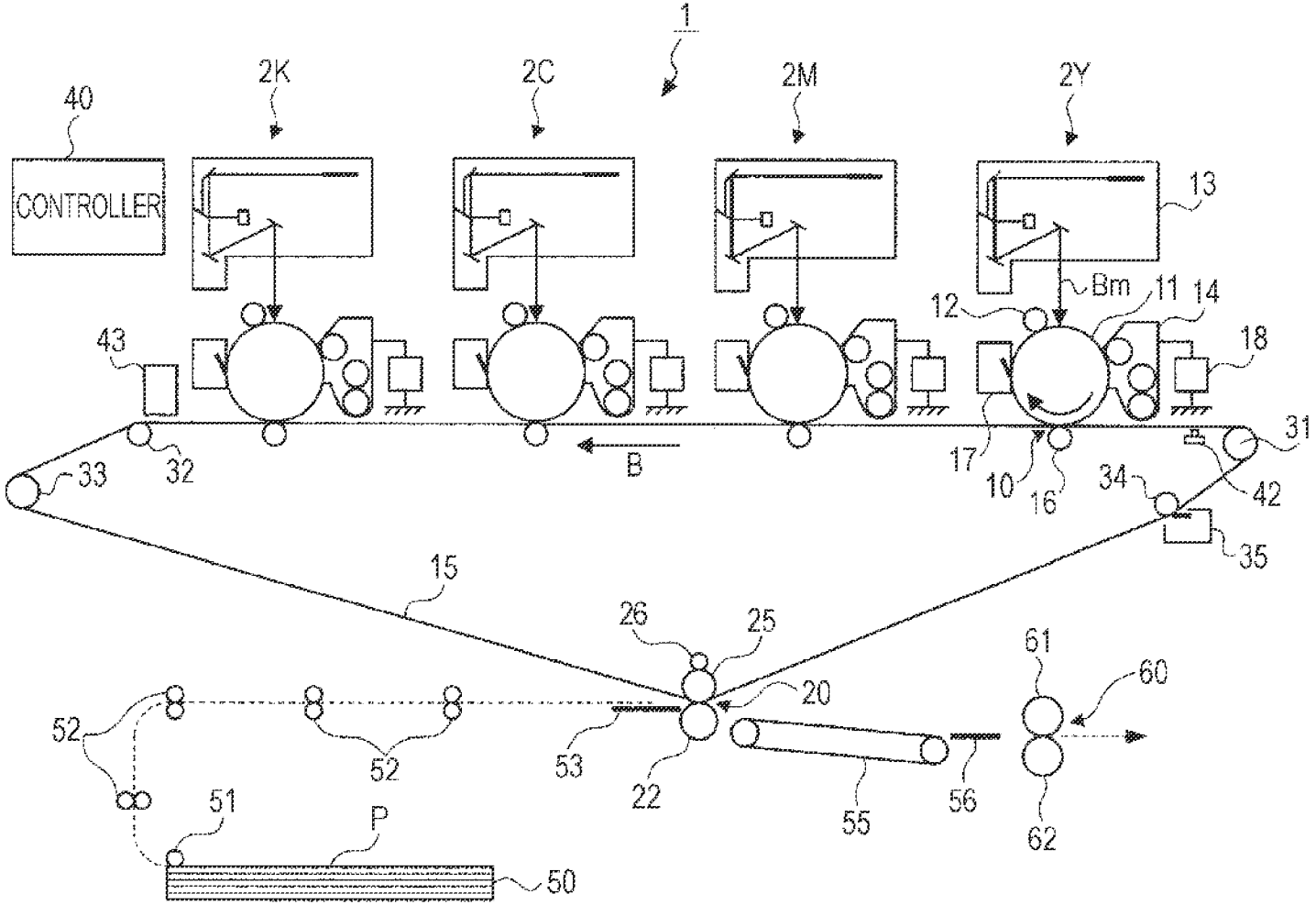
FIG. 1 schematically illustrates an example of the configuration of an image forming apparatus according to a first exemplary embodiment.

FIG. 1 schematically illustrates an example of the configuration of an image forming apparatus 1 according to a first exemplary embodiment. The image forming apparatus 1 shown in FIG. 1 is an intermediate-transfer-system image forming apparatus generally referred to as a "tandem image forming apparatus". The image forming apparatus 1 includes plural image forming units 2Y, 2M, 2C, and 2K, a first transfer unit 10, a second transfer unit 20, a fixing unit 60, and a controller 40. The image forming units 2Y, 2M, 2C, and 2K form toner images of associated color components by using an electrophotographic system. The first transfer unit 10 sequentially transfers toner images of associated colors (components) formed by the image forming units 2Y, 2M, 2C, and 2K to an intermediate transfer belt 15 (such an operation will be referred to as a "first transfer operation"). The second transfer unit 20, which is an example of a transfer unit, simultaneously transfers toner images (superposed toner images of associated colors) transferred onto the intermediate transfer belt 15 to a sheet P, which is an example of a transfer subject (such an operation will be referred to as a "second transfer operation"). The fixing unit 60 fixes toner images subjected to a second transfer operation on the sheet P. The controller 40, which is an example of a controller, controls operations of the individual devices (units).

In the first exemplary embodiment, the image forming units 2Y, 2M, 2C, and 2K each include electrophotographic devices sequentially disposed around a photoconductor drum 11, which is an example of an image carrier, rotating in the direction indicated by the arrow A in FIG. 1. Examples of the electrophotographic devices are a charging device 12, a laser exposure device 13, a developing device 14, a first transfer roller 16, and a drum cleaner 17. The charging device 12, which is an example of a charging unit, charges the photoconductor drum 11. The laser exposure device 13, which is an example of an exposure unit, writes an electrostatic latent image onto the surface of the photoconductor drum 11 (exposure beam is indicated by Bm in FIG. 1). The developing device 14, which is an example of a developing unit, stores therein toner of an associated color (component) and visualizes an electrostatic latent image with toner so as to form a toner image on the photoconductor drum 11. The first transfer roller 16 transfers, at a position at which the first transfer unit 10 is disposed, a toner image of the associated color formed on the photoconductor drum 11 onto the intermediate transfer belt 15. The drum cleaner 17 removes residual toner remaining on the photoconductor drum 11. The image forming units 2Y, 2M, 2C, and 2K are disposed linearly in the order of yellow (Y), magenta (M), cyan (C), and black (K) from the upstream side to the downstream side of the intermediate transfer belt 15.

As the photoconductor drum 11, an organic photosensitive layer formed on the surface of, for example, a metallic, thin-walled cylindrical drum is used. When a charging electric field (charging bias) is supplied to the photoconductor drum 11, the organic photosensitive layer is charged.

The charging device 12 is connected to a charging bias power supply source (not shown) which generates a charging electric field (charging bias) and supplies it to the surface of the photoconductor drum 11. The developing device 14 is connected to a developing bias power supply source 18 which generates a developing electric field (developing bias) and supplies it to the developing device 14.

It is assumed that the developing device 14 develops an electrostatic latent image by using a reversal developing method by way of example. In this method, toner used in the developing device 14 is of a negative charging type.

The voltage output from the charging bias power supply source is a voltage obtained by superposing a direct-current (DC) voltage of −600 V on an alternating-current (AC) voltage having a 2 kV peak-to-peak value (p-p value) at a frequency of 2 kHz. That is, with this voltage, the organic photosensitive layer of the photoconductor drum 11 is negatively charged. The voltage output from the developing bias power supply source 18 is a voltage obtained by superposing a DC voltage of −500 V on an AC voltage having a 1 kV p-p value. The frequency of the AC voltage will be discussed later.

The intermediate transfer belt 15, which is an example of an intermediate transfer body, is constituted by a film-like endless belt in which a suitable amount of anti-static agent, such as carbon black, is contained in a resin, such as polyimide or polyamide. The volume resistivity of the intermediate transfer belt 15 is $10^6$ to $10^{14}$ Ωcm and the thickness thereof is about 0.1 mm. The intermediate transfer belt 15 is driven (rotates) at a predetermined speed in the direction indicated by the arrow B shown in FIG. 1 by various rollers. Examples of the various rollers are a driving roller 31, a support roller 32, a tension roller 33, a backup roller 25, and a cleaning backup roller 34. The driving roller 31 is driven by a motor (not shown) having high constant speed properties and thereby rotates the intermediate transfer belt 15. The support roller 32 supports the intermediate transfer belt 15 linearly extending in the direction in which the photoconductor drums 11 are arranged. The tension roller 33 provides tension to the intermediate transfer belt 15 and also serves as a correction roller for preventing the intermediate transfer belt 15 from meandering. The backup roller 25 is disposed at a position at which the second transfer unit 20 is disposed. The cleaning backup roller 34 scrapes residual toner remaining on the intermediate transfer belt 15.

The first transfer unit 10 includes the first transfer roller 16 which opposes the photoconductor drum 11 with the intermediate transfer belt 15 therebetween. The first transfer roller 16 is constituted by a shaft and a sponge layer, which serves as an elastic layer, fixed around the shaft. The shaft is a columnar bar made of a metal, such as iron, SUS, etc. The sponge layer is a sponge-like cylindrical roller made of a rubber blend of NBR, SBR, and EPDM mixed with a conductive agent, such as carbon black, and has a volume resistivity of about $10^7$ to $10^9$ Ωcm. The first transfer roller 16 is pressed against the photoconductor drum 11 with the intermediate transfer belt 15 therebetween.

A voltage (first transfer bias) of a polarity opposite to the charge polarity of toner (in this example, a negative polarity) is applied to the first transfer roller 16 by a first transfer power supply source (not shown). With the application of the first transfer bias, toner images formed on the photoconductor drums 11 are electrostatically attracted to the intermediate transfer belt 15 sequentially, thereby forming superposed toner images on the intermediate transfer belt 15.

The second transfer unit 20 includes a second transfer roller 22 opposing the backup roller 25 with the intermediate transfer belt 15 therebetween. The second transfer roller 22 is disposed on the surface of the intermediate transfer belt 15 on which toner images are held. The second transfer roller 22 is grounded. A metallic feeding roller 26 is in contact with the backup roller 25. A second transfer bias is applied to the feeding roller 26 by a second transfer bias power supply source (not shown).

The surface of the backup roller 25 is made of a tubular rubber blend of EPDM and NBR in which carbon is dispersed, and the inside of the backup roller 25 is made of EPDM rubber. The surface resistivity of the backup roller 25 is set to be $10^7$ to $10^{10}$ Ω/sq., and the hardness thereof is set to be, for example, 70° (Asker C).

The second transfer roller 22 is constituted by a shaft and a sponge layer, which serves as an elastic layer, fixed around the shaft. The shaft is a columnar bar made of a metal, such as iron, SUS, etc. The sponge layer is a sponge-like cylindrical roller made of a rubber blend of NBR, SBR, and EPDM mixed with a conductive agent, such as carbon black, and has a volume resistivity of $10^7$ to $10^9$ Ωcm. The second transfer roller 22 is pressed against the backup roller 25 with the intermediate transfer belt 15 therebetween, and forms a transfer nip area, together with the backup roller 25.

A sheet P is transported to the second transfer unit 20 including the grounded second transfer roller 22 and the backup roller 25 to which a second transfer bias is supplied through the feeding roller 26. Toner images held on the intermediate transfer belt 15 are then transferred onto the sheet P.

An intermediate transfer belt cleaner 35 is provided on the intermediate transfer belt 15 on the downstream side of the second transfer unit 20. The intermediate transfer belt cleaner 35 is movable close to and away from the intermediate transfer belt 15, and removes residual toner or paper dust on the intermediate transfer belt 15 after a second transfer operation is performed, thereby cleaning the surface of the intermediate transfer belt 15. A reference sensor (home position sensor) 42 is disposed on the upstream side of the image forming unit 2Y. The reference sensor 42 generates a reference signal indicating a reference for providing timing of forming images in the image forming units 2Y, 2M, 2C, and 2K. An image density sensor 43 for adjusting the image quality is disposed on the downstream side of the image forming unit 2K.

The reference sensor 42 generates a reference signal upon recognizing a predetermined mark provided on the back side of the intermediate transfer belt 15. The image forming units 2Y, 2M, 2C, and 2K start to form images in response to an instruction from the controller 40 based on the reference signal.

The image density sensor 43 detects test toner images used for controlling the density. On the basis of results of detecting the test toner images by the image density sensor 43, operating conditions of the image forming units 2Y, 2M, 2C, and 2K are adjusted, thereby controlling the density of toner images to be formed.

The image forming apparatus 1 of the first exemplary embodiment also includes, as a sheet transport system, a sheet supply unit 50, a pickup roller 51, transport rollers 52, a sheet transport path 53, a transport belt 55, and a fixing entrance guide 56. The sheet supply unit 50 stores sheets P therein. The pickup roller 51 extracts a sheet P stored in the sheet supply unit 50 at a predetermined timing and feeds the extracted sheet P. The transport rollers 52 transport the sheet P fed by the pickup roller 51. The sheet transport path 53 feeds the sheet P transported by the transport rollers 52 to the second transfer unit 20. The transport belt 55 transports the sheet P subjected to a second transfer operation by using the second transfer roller 22 to the fixing unit 60. The fixing entrance guide 56 guides the sheet P to the fixing unit 60.

The fixing unit 60 includes a heating roller 61 having a built-in heating source, such as a halogen lamp, and a pressing roller 62 which abuts against the heating roller 61. The fixing unit 60 causes the sheet P onto which toner images are transferred to pass through a fixing nip area formed between the heating roller 61 and the pressing roller 62, thereby fixing the toner images on the sheet P.

A description will now be given of a basic image forming process in the image forming apparatus 1 of the first exemplary embodiment. In the image forming apparatus 1, an image processing apparatus (not shown) performs predetermined image processing on image data output from an image reader (not shown) or a personal computer (PC) (not shown). Then, the image data is input into the image forming units 2Y, 2M, 2C, and 2K, and the image forming units 2Y, 2M, 2C, and 2K start an image forming operation. The image processing apparatus performs predetermined image processing, such as shading correction, misregistration correction, lightness/color-space conversion, gamma correction, and various image editing, such as border erase, color change, move, etc., on input reflectance data. The image data subjected to image processing is converted into items of tone data of four color materials, such as Y, M, C, and K, which are then output to the laser exposure devices 13.

The laser exposure devices 13 irradiate the associated photoconductor drums 11 of the image forming units 2Y, 2M, 2C, and 2K with an exposure beam Bm emitted from, e.g., semiconductor lasers, in accordance with the input items of color-material tone data. After the surfaces of the photoconductor drums 11 of the image forming units 2Y, 2M, 2C, and 2K are charged by the charging devices 12, they are scanned with light by the laser exposure devices 13, thereby forming electrostatic latent images on the surfaces of the photoconductor drums 11. The electrostatic latent images are developed by the developing devices 14 of the image forming units 2Y, 2M, 2C, and 2K as Y, M, C, and K toner images, respectively.

In this case, each of the developing devices 14 develops an electrostatic latent image by using the reversal developing method. As stated above, the surface of the photoconductor drum 11 is charged to a charging bias (e.g., a DC voltage of −600 V). When writing an image onto the surface of the photoconductor drum 11 by the laser exposure device 13, the electrical conductivity on the surface of the photoconductor drum 11 is increased, and the potential of a portion exposed to light by the laser exposure device 13 is changed from −600 V to, for example, −200 V. Meanwhile, a developing bias (e.g., a DC voltage of −500 V) is supplied to the developing device 14. Then, toner, which is of a negative charging type, adheres to the portion having a potential of −200 V on the surface of the photoconductor drum 11. In this manner, toner images of the associated colors are formed.

The toner images of the associated colors formed on the photoconductor drums 11 of the image forming units 2Y, 2M, 2C, and 2K are transferred onto the intermediate transfer belt 15 at the first transfer units 10 in which the photoconductor drums 11 and the intermediate transfer belt 15 are in contact with each other. More specifically, at a position at which each of the first transfer units 10 is provided, a voltage (first transfer bias) of a polarity (positive) opposite to the charge polarity of toner is applied to the base material of the intermediate transfer belt 15 through the first transfer roller 16. With the application of the first transfer bias, toner images formed on the photoconductor drums 11 are sequentially transferred to the surface of the intermediate transfer belt 15 such that they are superposed on one another (first transfer operation).

After the toner images are sequentially transferred onto the surface of the intermediate transfer belt 15, the intermediate transfer belt 15 is moved so as to cause the toner images to be transported to the second transfer unit 20. Then, in the sheet transport system, in synchronization with the time at which the toner images are transported to the second transfer unit 20, the pickup roller 51 starts rotating and a sheet P having a predetermined size is supplied from the sheet supply unit 50. The sheet P is further transported through the transport rollers 52 and passes through the sheet transport path 53 and reaches the second transfer unit 20. Before reaching the second transfer unit 20, the transportation of the sheet P is suspended, and a registration roller (not shown) starts rotating in synchronization with the timing of the movement of the intermediate transfer belt 15 on which the toner images are held, thereby adjusting the position of the sheet P to the position of the toner images.

In the second transfer unit 20, the second transfer roller 22 is pressed against the backup roller 25 through the intermediate transfer belt 15. Then, the sheet P, which has reached the second transfer unit 20 in synchronization with the movement of the intermediate transfer belt 15, is inserted between the intermediate transfer belt 15 and the second transfer roller 22. At this time, a voltage (negative-voltage transfer electric field (second transfer bias)) having the same polarity (negative) as the charge polarity of toner is supplied from a transfer bias power supply source (not shown) to the backup roller 25 through the feeding roller 26. Then, a transfer electric field is formed between the second transfer roller 22 and the backup roller 25. Then, the toner images, which are not yet fixed, held on the intermediate transfer belt 15 are electrostatically transferred onto the sheet P simultaneously in the second transfer unit 20 in which the intermediate transfer belt 15 is pressed by the second transfer roller 22 and the backup roller 25.

Subsequently, the sheet P onto which the toner images are electrostatically transferred is transported by the second transfer roller 22 in the state in which it is removed from the intermediate transfer belt 15, and reaches the transport belt 55 disposed on the downstream side of the second transfer roller 22 in the sheet transport direction. The transport belt 55 transports the sheet P to the fixing unit 60 at an optimal transport speed in accordance with the transport speed of the fixing unit 60. Then, the toner images, which are not yet fixed, on the sheet P which is transported to the fixing unit 60 are subjected to fixing processing by using heat and pressure in the fixing unit 60, whereby the toner images are fixed on the sheet P. The sheet P on which a fixed image is formed is then transported to a discharge paper storage unit (not shown) provided in a discharge unit of the image forming apparatus 1.

Meanwhile, after finishing transferring the toner images onto the sheet P, residual toner (including test toner images) remaining on the intermediate transfer belt 15 is transported in accordance with the rotation of the intermediate transfer belt 15, and is removed from the intermediate transfer belt 15 by the cleaning backup roller 34 and the intermediate transfer belt cleaner 35.

Configuration of Developing Bias Power Supply Source 18

Figure 2:
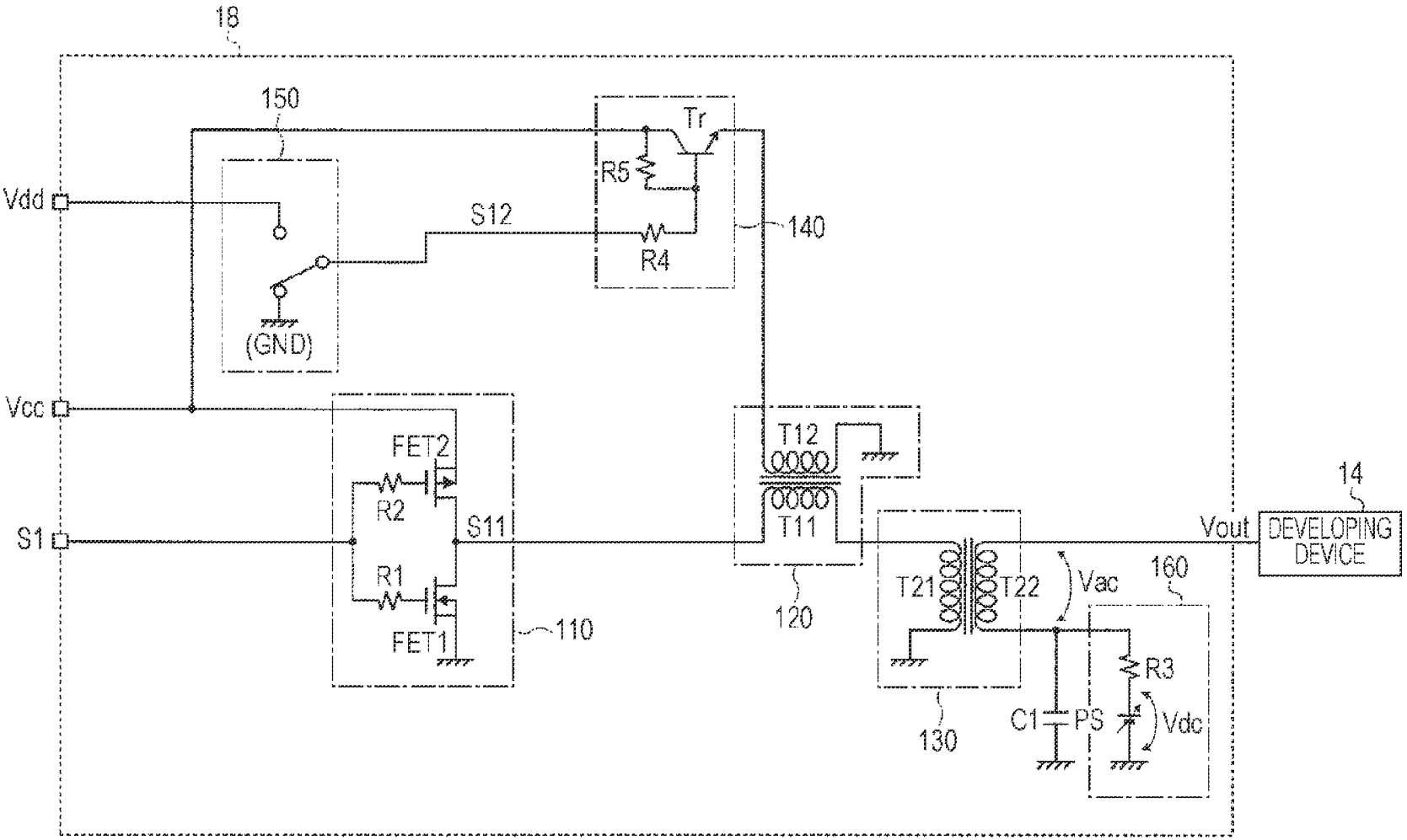
FIG. 2 illustrates an example of a developing bias power supply source of the first exemplary embodiment.

FIG. 2 illustrates an example of the developing bias power supply source 18 of the first exemplary embodiment.

The developing bias power supply source 18 outputs an output voltage Vout obtained by superposing a DC voltage Vdc on an AC voltage Vac. The developing bias power supply source 18 is a switching power supply source which generates a high AC voltage Vac by switching a switching device.

The circuit block of the developing bias power supply source 18 will first be discussed. The circuit block of the developing bias power supply source 18 is indicated by an area surrounded by long dashed dotted lines.

The developing bias power supply source 18 receives, from the controller 40, an AC setting signal S1, which is subjected to pulse width modulation (PWM), for setting the frequency of the AC voltage Vac to be superposed on a DC voltage Vdc in the output voltage Vout. The AC setting signal S1 has an amplitude defined by a low level voltage (hereinafter indicated by "L") and a high level voltage (hereinafter indicated by "H"). For example, L is 0 V, and H is 5 V.

A power supply voltage Vcc (e.g., 24 V) and a power supply voltage Vdd (e.g., 5 V) are supplied to the developing bias power supply source 18. A ground voltage GND (e.g., 0 V) is used as a reference.

It is assumed, in this example, that H is equal to the power supply voltage Vdd (5 V), and L is equal to the ground voltage (0 V).

The developing bias power supply source 18 includes a switching circuit 110, a current control transformer 120, an output transformer 130, a drive circuit 140, a changeover switch 150, and a DC voltage circuit 160. The switching circuit 110, which is an example of a switching unit, includes a switching device. The current control transformer 120 is an example of a current control circuit and an example of a current controller for controlling a current flowing from the switching circuit 110 to the output transformer 130. The output transformer 130 outputs the AC voltage Vac by using a current flowing through the switching circuit 110. The drive circuit 140, which is an example of a driving unit, drives the current control transformer 120. The changeover switch 150 changes the operating state of the drive circuit 140. The DC voltage circuit 160 generates a DC voltage Vdc to be superposed on the AC voltage Vac.

The developing bias power supply source 18 also includes a capacitor C1 which bypasses the AC voltage Vac output from the output transformer 130.

The circuit configurations of the individual circuit blocks will now be described below.

Switching Circuit 110

The switching circuit 110 includes an n-channel field effect transistor (FET1) and a p-channel FET2, each of which serve as a switching device, and resistors R1 and R2.

The source terminal of the FET1 is grounded (ground voltage GND). The power supply voltage Vcc is supplied to the source terminal of the FET2. The drain terminal of the FET1 and the drain terminal of the FET2 are connected to each other, and the node therebetween serves as an output terminal. The output terminal of the switching circuit 110 is connected to the current control transformer 120 and outputs the switching signal S11 to the current control transformer 120.

The gate terminal of the FET1 is connected to one terminal of the resistor R1, while the gate terminal of the FET2 is connected to one terminal of the resistor R2. The other terminal of the resistor R1 and the other terminal of the resistor R2 are connected to each other, and the node thereof serves as the input terminal of the switching circuit 110. The input terminal of the switching circuit 110 receives the AC setting signal S1 from the controller 40.

In the switching circuit 110, when the AC setting signal is "L", the FET1 is OFF, and the FET2 is ON, thereby outputting the power supply voltage Vcc as the switching signal S11. On the other hand, when the AC setting signal is "H", the FET1 is ON, and the FET2 is OFF, thereby outputting the ground voltage GND as the switching signal S11.

Current Control Transformer 120

The current control transformer 120 includes a primary winding T11 and a secondary winding T12.

One terminal of the primary winding T11 is connected to the output terminal (node between the drain terminal of the FET1 and the drain terminal of the FET2) of the switching circuit 110. The other terminal of the primary winding T11 is connected to the output transformer 130.

One (first) terminal of the secondary winding T12 is connected to the drive circuit 140, and the other (second) terminal thereof is grounded (ground voltage GND).

In the current control transformer 120, the value of the impedance Z (more specifically, the inductance Lz) of the primary winding T11 is changed due to a current flowing through the secondary winding T12. That is, in the current control transformer 120, a current is caused to flow in the secondary winding T12 so as to change the magnetic flux density of a core, such as iron or ferrite, wound around each of the primary winding T11 and the secondary winding T12, thereby changing the inductance Lz of the primary winding T11.

By changing the inductance Lz of the primary winding T11 of the current control transformer 120, a current flowing from the switching circuit 110 to the output transformer 130 is controlled.

Output Transformer 130

The output transformer 130 includes a primary winding T21 and a secondary winding T22.

One terminal of the primary winding T21 is connected to the other terminal of the primary winding T11 of the current control transformer 120. The other terminal of the primary winding T21 is grounded (ground voltage GND).

One terminal of the secondary winding T22 is connected to the developing device 14. The other terminal of the secondary winding T22 is grounded (ground voltage GND) via the capacitor C1 and is also connected to the DC voltage circuit 160.

When the FET1 is OFF and the FET2 is ON in the switching circuit 110, a current flows through the primary winding T21 of the output transformer 130 in the direction from the power supply voltage Vcc to the ground voltage GND (in the direction from the top to the bottom in the plane of FIG. 2). When the FET1 is ON and the FET2 is OFF, a current flows through the primary winding T21 of the output transformer 130 in the direction from the ground voltage GND to the power supply voltage Vcc (in the direction from the bottom to the top in the plane of FIG. 2).

Due to the currents flowing through the primary winding T21 of the output transformer 130, the AC voltage Vac is induced in the secondary winding T22.

Drive Circuit 140

The drive circuit 140 includes an npn transistor Tr and resistors R4 and R5.

One (first) terminal of the resistor R4 is connected to the output terminal of the changeover switch 150, which will be discussed later. The other (second) terminal of the resistor R4 and one terminal of the resistor R5 are connected to the base terminal of the npn transistor Tr. The other terminal of the resistor R5 is connected to the collector terminal of the npn transistor Tr. The power supply voltage Vcc (24 V) is supplied to the collector terminal of the npn transistor Tr. The emitter terminal of the npn transistor Tr is connected to the first terminal of the secondary winding T12 of the current control transformer 120.

When the output terminal of the changeover switch 150, which will be discussed later, is set to be the power supply voltage Vdd (5 V), the npn transistor Tr is turned ON, and a current flows from the power supply voltage Vcc (24 V) to the secondary winding T12 of the current control transformer 120 through the npn transistor Tr. Due to this current, the magnetic flux density of the core of the current control transformer 120 is saturated, thereby decreasing the inductance Lz of the primary winding T11 of the current control transformer 120.

The magnetic flux density of the core does not have to be saturated as long as the inductance Lz of the primary winding T11 of the current control transformer 120 is decreased due to a current flowing through the secondary winding T12.

Changeover Switch 150

The changeover switch 150 is a two input one output switch. One input terminal is connected to a ground voltage (GND), while the other input terminal is connected to the power supply voltage Vdd (5 V). The output terminal is connected to the first terminal of the resistor R4 of the drive circuit 140, and a changing signal S12 is output through this output terminal.

By switching between the two input terminals of the changeover switch 150, the changing signal S12 is set to be one of the ground voltage GND and the power supply voltage Vdd.

DC voltage Circuit 160

The DC voltage circuit 160 includes a DC voltage source PS and a resistor R3.

The DC voltage source PS generates the DC voltage Vdc between the ground voltage GND and the output terminal. One terminal of the resistor R3 is connected to the output terminal of the DC voltage source PS, and the other terminal thereof is connected to one terminal of the capacitor C1. The resistor R3 is a current limiting resistor.

Operation of Developing Bias Power Supply Source 18

The operation of the developing bias power supply source 18 will be described below.

Figure 3B:
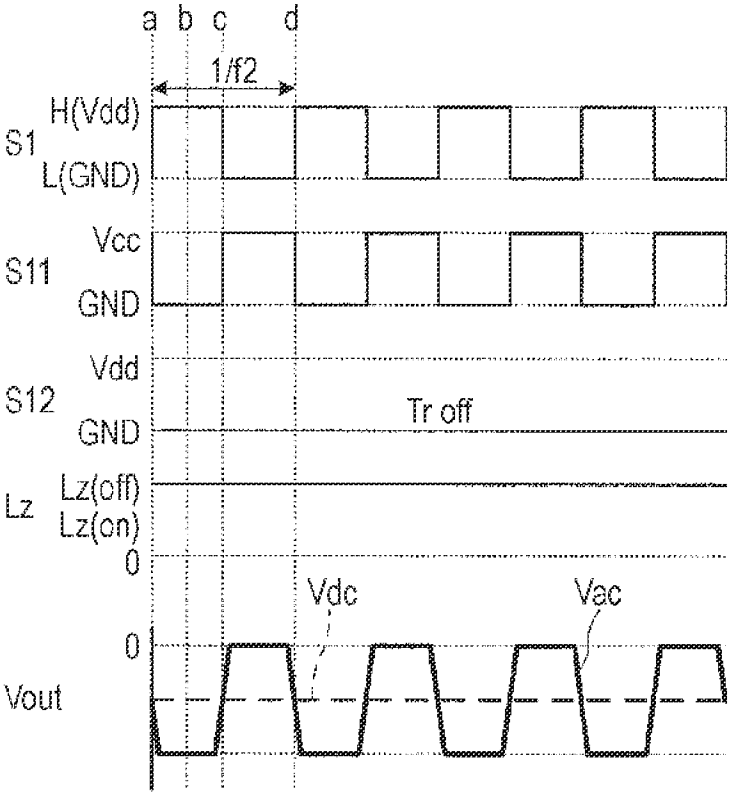
FIGS. 3A and 3B are timing charts illustrating operations of a developing bias power supply source of the first exemplary embodiment.
Figure 3A:
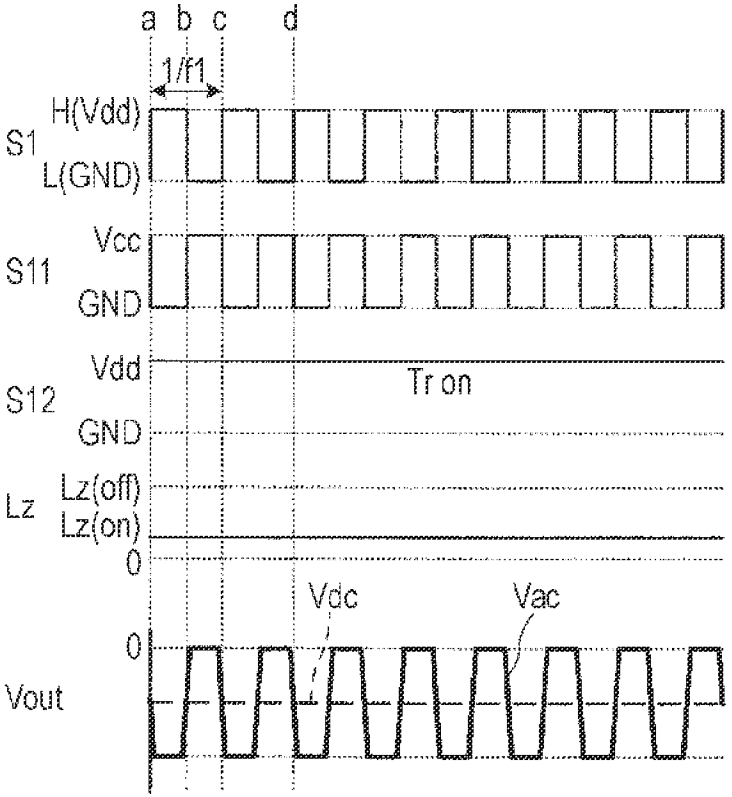

FIGS. 3A and 3B are timing charts illustrating the operations of the developing bias power supply source 18 of the first exemplary embodiment. More specifically, FIG. 3A illustrates the operation of the developing bias power supply source 18 when the AC setting signal S1 is a frequency f1, which is an example of a first frequency. FIG. 3B illustrates the operation of the developing bias power supply source 18 when the AC setting signal S1 is a frequency f2, which is an example of a second frequency. The second frequency f2 is lower than the frequency f1. In this example, the frequency f1 is assumed as a high frequency, while the frequency f2 is assumed as a low frequency.

For example, the frequency f1 is 12 to 22 kHz, while the frequency f2 is 6 to 11 kHz. As stated above, the output voltage Vout is obtained by superposing a DC voltage Vdc of, for example, −500 V, on an AC voltage Vac having a p-p value of, for example, 2 kV. These values are only examples, and may be changed.

In FIGS. 3A and 3B, the AC setting signal S1, the switching signal S11, the changing signal S12, the inductance Lz of the primary winding T11 of the current control transformer 120, and the output voltage Vout are shown.

In FIGS. 3A and 3B, the duty ratio of the AC setting signal S1 is set to be 50%. The AC voltage Vac is set by the duty ratio of the AC setting signal S1, and thus, the duty ratio may be other than 50%.

The time elapses in alphabetical order, such as time a, time b, so on. It is assumed that the time indicated in FIG. 3A is the same as the time indicated in FIG. 3B.

A description will first be given of the operation of the developing bias power supply source 18 when the AC setting signal S1 shown in FIG. 3A is a high frequency (frequency f1).

When the AC setting signal S1 is a high frequency, the duration from time a to time c is set as the period (=1/f1) of the AC setting signal S1. In this case, the duration from time a to time b is "H" (Vdd (5 V)), while the duration from time b to time c is "L" (GND (0 V)). Then, after time c, the signal waveform from time a to time b is repeated.

When the AC setting signal S1 is "H", the FET1 is ON and the FET2 is OFF in the switching circuit 110, and thus, the switching signal S11 output from the switching circuit 110 is set to be the ground voltage GND (e.g., duration from time a to time b). When the AC setting signal S1 is "L", the FET1 is OFF and the FET2 is ON in the switching circuit 110, and thus, the switching signal S11 output from the switching circuit 110 is set to be the power supply voltage Vcc (e.g., duration from time b to time c). That is, the voltage levels of the switching signal S11 are opposite to those of the AC setting signal S1.

When the AC setting signal S1 is a high frequency, the output terminal of the changeover switch 150 is connected to the input terminal connected to the power supply voltage Vdd so that the power supply voltage Vdd is output as the changing signal S12. When the changing signal S12 indicates the power supply voltage Vdd, the npn transistor Tr of the drive circuit 140 is ON (indicated by "Tr on" in FIG. 3A).

Accordingly, a current flows through the secondary winding T12 of the current control transformer 120, and the inductance Lz (hereinafter indicated by "inductance Lz (on)") of the primary winding T11 is smaller than the inductance Lz (hereinafter indicated by "inductance Lz (off)") when a current does not flow through the secondary winding T12.

When a current flows through the primary winding T21 of the output transformer 130, a current is induced in the secondary winding T22, thereby outputting the AC voltage Vac determined by the turns ratio (ratio of the number of turns of the secondary winding T22 to that of the primary winding T21). The current flowing through the primary winding T21 flows in the direction from the power supply voltage Vcc to the ground voltage GND when the FET1 is OFF and the FET2 is ON. The current flowing through the primary winding T21 flows in the direction from the ground voltage GND to the power supply voltage Vcc when the FET1 is ON and the FET2 is OFF. Due to the currents flowing through the primary winding T21, the AC voltage Vac which changes in accordance with the switching signal S11 is generated in the secondary winding T22. The AC voltage Vac is not a sine wave, but a square (trapezoidal) wave.

The current flowing through the primary winding T21 of the output transformer 130 is limited (controlled) by the inductance Lz (on) of the primary winding T11 of the current control transformer 120. Since the inductance Lz (on) is smaller than the inductance Lz (off), the current flowing through the primary winding T21 is limited by a smaller level by the inductance Lz (on) than by the inductance (off). Thus, when the AC setting signal S1 is a high frequency, the AC voltage Vac maintains a (square) trapezoidal waveform.

A description will now be given of the operation of the developing bias power supply source 18 when the AC setting signal S1 shown in FIG. 3B is a low frequency (frequency f2).

When the AC setting signal S1 is a low frequency, the duration from time a to time c is set as the period (=1/f2) of the AC setting signal S1. In this case, the duration from time a to time c is "H" (Vdd (5 V)), and the duration from time c to time d is "L" (GND (0 V)). Then, after time d, the waveform from time a to time c is repeated. That is, in FIG. 3B, the frequency f2 is set to be ½ the frequency f1.

As in FIG. 3A, in FIG. 3B, the voltage levels of the switching signal S11 output from the switching circuit 110 are opposite to those of the AC setting signal S1.

When the AC setting signal S1 is a low frequency, the output terminal of the changeover switch 150 is connected to the input terminal connected to the ground voltage GND so that the ground voltage GND is output as the changing signal S12. When the changing signal S12 indicates the ground voltage GND, the npn transistor Tr of the drive circuit 140 is OFF (indicated by "Tr off" in FIG. 3B).

Accordingly, the inductance of the primary winding T11 of the current control transformer 120 is set to be the inductance Lz (off), which is greater than the inductance Lz (on).

Thus, a current flowing from the switching circuit 110 to the output transformer 130 is limited. The current is limited, particularly, when the switching signal S11 rises from the ground voltage GND to the power supply voltage Vcc and falls from the power supply voltage Vcc to the ground voltage GND.

As in the case of a high frequency, due to the current flowing through the primary winding T21 of the output transformer 130, the AC voltage Vac which changes in accordance with the switching signal S11 is generated in the secondary winding T22.

The current flowing through the primary winding T21 of the output transformer 130 is limited (controlled) by the inductance Lz (off) of the primary winding T11 of the current control transformer 120. The inductance Lz (off) is greater than the inductance Lz (on). Thus, the current is limited by a greater level by the inductance Lz (off) than by the inductance Lz (on).

As described above, when the AC setting signal S1 is a high frequency, a current is caused to flow through the secondary winding T12 of the current control transformer 120 so as to decrease the inductance Lz of the primary winding T11 (to set the inductance of the primary winding T11 to be the inductance Lz (on)). With this operation, the function of limiting a current becomes smaller than that when the AC setting signal S1 is a low frequency.

In contrast, when the AC setting signal S1 is a low frequency, a current does not flow through the secondary winding T12 of the current control transformer 120 so as to increase the inductance Lz of the primary winding T11 (to set the inductance of the primary winding T11 to be the inductance Lz (off)). With this operation, the function of limiting a current becomes greater than that when the AC setting signal S1 is a high frequency.

For enhancing the quality of images formed in the image forming apparatus 1, it is desirable to decrease the particle size of toner and to increase the frequency of the AC voltage Vac to be applied to the developing device 14. The particle size of toner may desirably be reduced from 5 μm, which is widely used, to 3 μm. The AC voltage Vac may desirably be increased from a range of 6 to 11 kHz, which is widely used, to a range of 12 to 22 kHz.

The AC voltage Vac of the output voltage Vout to be applied to the developing device 14 may desirably be a square (trapezoidal) wave having sharp rising and falling edges instead of a sine wave. This is because the effective value (root mean square (rms) value) of the AC voltage Vac may most effectively contribute to the developing performance of the developing device 14 and because a smaller p-p value of the AC voltage Vac may be desirable in terms of the configuration of the developing device 14. That is, for decreasing the p-p value and increasing the effective value, it is desirable to form the waveform of the AC voltage Vac as a square (trapezoidal) wave.

In a developing bias power supply source 18 which is designed for a low-frequency AC setting signal S1, if the frequency of the AC setting signal S1 is increased, it is difficult for an output transformer 130 which normally handles a low frequency to follow such a high frequency. Accordingly, if the frequency of the AC setting signal S1 is increased, the square (trapezoidal) waveform of the AC setting signal S1 is not maintained and becomes blunt. As a result, the developing performance is decreased.

Thus, when a high-frequency AC setting signal S1 is used, a developing bias power supply source 18 using an output transformer 130 which is capable of following a high frequency is necessary. In order to handle a high frequency, a transformer having a large coupling coefficient and a small leakage field is used as the output transformer 130. If the AC setting signal S1 is 6 to 11 kHz, an output transformer 130 having a leakage field of about 50 μH may be used. If the AC setting signal S1 is 12 to 22 kHz, an output transformer 130 having a leakage field of about 5 μH may be used.

However, when a low-frequency current having a square (trapezoidal) wave flows through the primary winding T21 of the output transformer 130 having a small leakage field, a larger current flows through the output transformer 130 than through an output transformer 130 having a large leakage field. Particularly at the rising and falling edges of a square (trapezoidal) wave, a large current flows. Accordingly, the FET1 and the FET2 of the switching circuit 110 and/or the output transformer 130 may be heated and may be broken.

In contrast, in the first exemplary embodiment, the current control transformer 120 is provided. When the AC setting signal S1 is a high frequency (frequency f1), a current does not flow through the secondary winding T12 of the current control transformer 120 so as to saturate the magnetic flux density of the core, thereby decreasing the inductance Lz of the primary winding T11. As a result, a current flows through the output transformer 130 more easily. With this arrangement, when the AC setting signal S1 is a high frequency (frequency f1), the square (trapezoidal) waveform of the AC voltage Vac is maintained.

On the other hand, when the AC setting signal S1 is a low frequency (frequency f2), a current is not caused to flow through the secondary winding T12 of the current control transformer 120 so as to increase the inductance Lz of the primary winding T11, thereby making it difficult for the current to flow in the output transformer 130. With this arrangement, it is possible to prevent an excessive current from flowing from the switching circuit 110 to the output transformer 130. This may also inhibit the FET1 and the FET2 of the switching circuit 110 and/or the output transformer 130 from being heated.

With this arrangement, the developing bias power supply source 18 suitably designed for a high-frequency AC setting signal S1 may also be used for a low-frequency AC setting signal S1. Accordingly, it is not necessary to provide a developing bias power supply source 18 suitably designed for a particular frequency of the AC setting signal S1.

In the first exemplary embodiment, as shown in FIG. 2, the changing signal S12 is set to be the power supply voltage Vdd or the ground voltage GND by using the changeover switch 150. That is, when integrating the developing bias power supply source 18 into the image forming apparatus 1, the changeover switch 150 is set in accordance with the frequency of the AC voltage Vac to be supplied to the developing device 14, i.e., the frequency of the AC setting signal S1.

Alternatively, the controller 40 may supply the changing signal S12 corresponding to the frequency of the AC setting signal S1 to the drive circuit 140.

Second Exemplary Embodiment

In a second exemplary embodiment, in the developing bias power supply source 18, an integrating circuit 170, which is an example of an integrator, and a comparator 180, which is an example of a comparator, are provided instead of the changeover switch 150. The changing signal S12 is set on the basis of the AC setting signal S1.

Hereinafter, portions similar to the first exemplary embodiment will be omitted, and portions different from the first exemplary embodiment will be described.

Configuration of Developing Bias Power Supply Source 18

Figure 4:
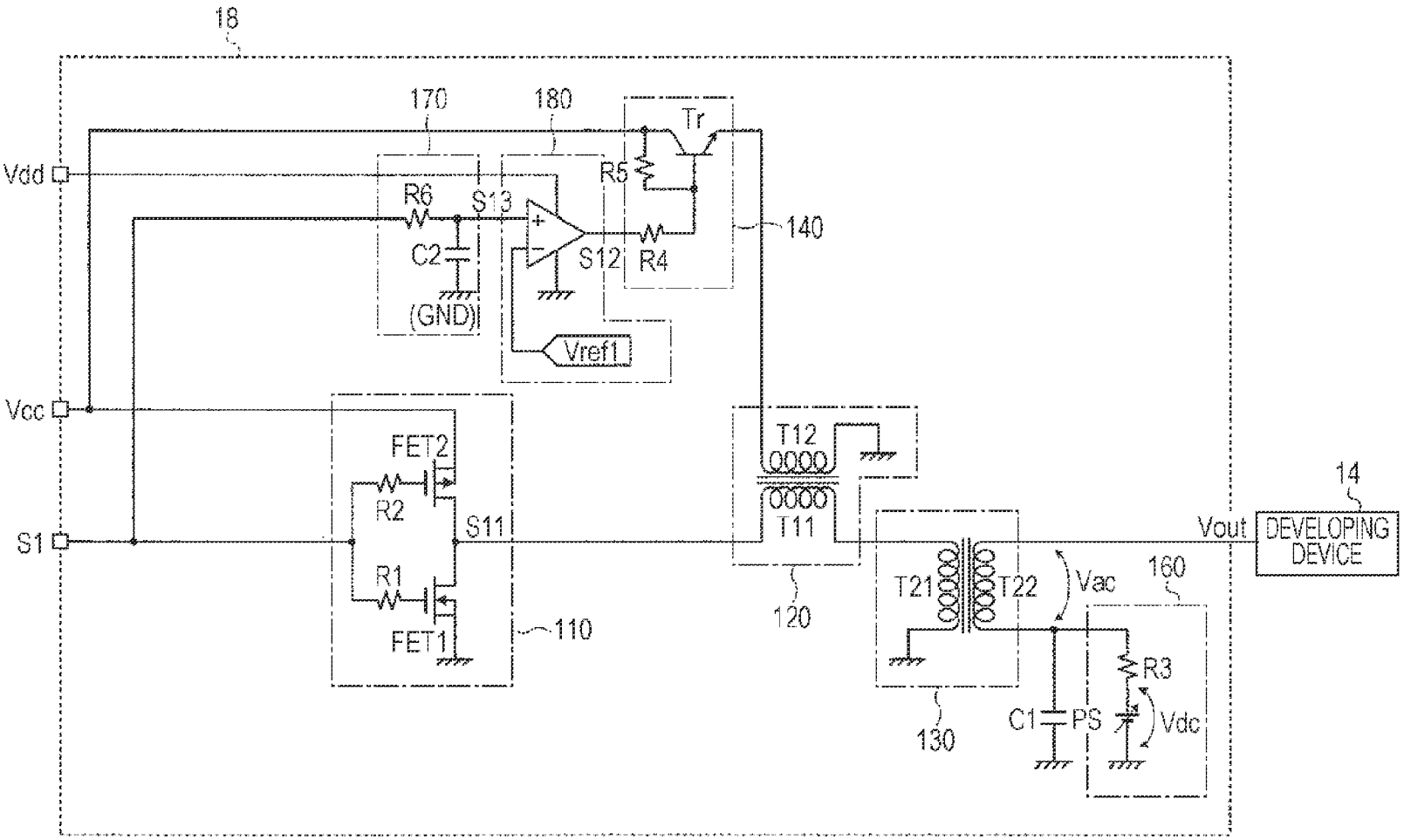
FIG. 4 illustrates an example of a developing bias power supply source of a second exemplary embodiment.

FIG. 4 illustrates an example of the developing bias power supply source 18 of the second exemplary embodiment.

The integrating circuit 170 and the comparator 180 substituted for the changeover switch 150 will be principally discussed.

Integrating Circuit 170

The integrating circuit 170 includes a capacitor C2 and a resistor R6.

One terminal of the resistor R6 serves as the input terminal of the integrating circuit 170, and receives the AC setting signal S1 from the controller 40. The other terminal of the resistor R6 is connected to one (first) terminal of the capacitor C2 and serves as the output terminal of the integrating circuit 170. The output terminal of the integrating circuit 170 is connected to the comparator 180, and an integration signal S13 is output through this output terminal. The other (second) terminal of the capacitor C2 is grounded (ground voltage GND).

Upon receiving the AC setting signal S1 through the input terminal of the integrating circuit 170, the capacitor C2 accumulates (integrates) electric charge. Then, the first terminal of the capacitor C2 is set to be a voltage proportional to the duty ratio of the AC setting signal S1, which is a PWM signal. That is, the integration signal S13 indicates a voltage proportional to the duty ratio of the AC setting signal S1.

Comparator 180

The comparator 180 includes a non-inverting input terminal (hereinafter indicated by the "+ input terminal"), an inverting input terminal (hereinafter indicated by the "– input terminal"), and an output terminal.

The + input terminal of the comparator 180 is connected to the first terminal of the capacitor C2 of the integrating circuit 170. A reference voltage Vref1 is supplied to the – input terminal. The output terminal is connected to the first terminal of the resistor R4 of the drive circuit 140.

A power supply voltage Vdd (5 V) and a ground voltage GND (0 V) are supplied to the comparator 180.

The comparator 180 outputs the changing signal S12 which is set to be the power supply voltage Vdd (5 V) when the voltage of the + input terminal is equal to or higher than the reference voltage Vref1, which is the voltage of the – input terminal. On the other hand, the comparator 180 outputs the changing signal S12 which is set to be the ground voltage GND (0 V) when the voltage of the + input terminal is smaller than the reference voltage Vref1.

Operation of Developing Bias Power Supply Source 18

Figure 5B:
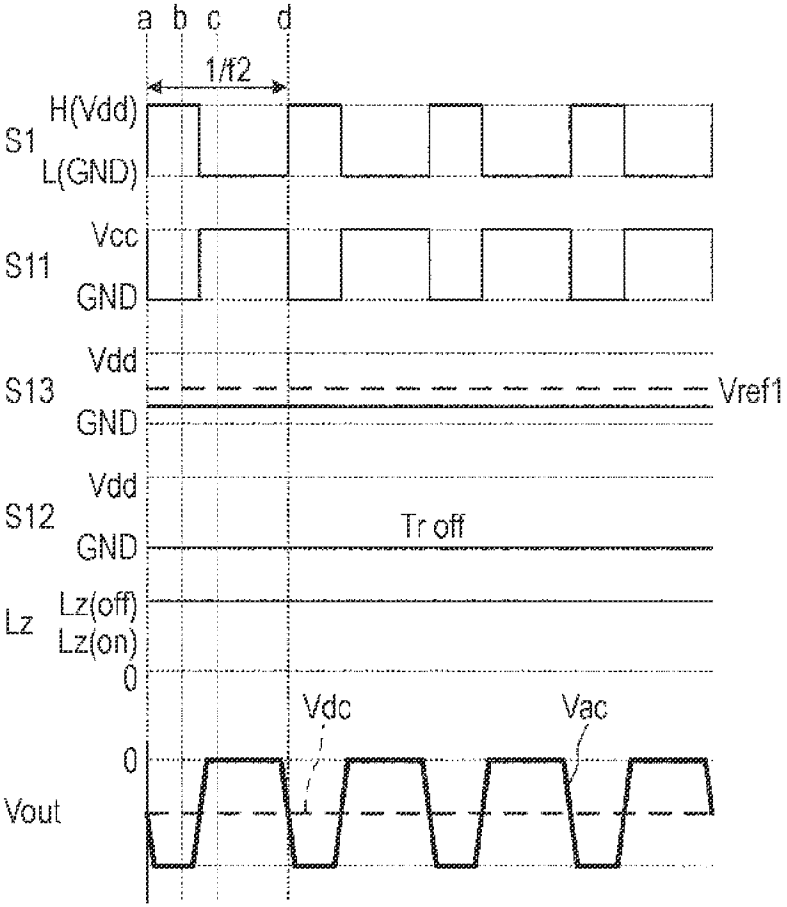
FIGS. 5A and 5B are timing charts illustrating operations of a developing bias power supply source of the second exemplary embodiment.
Figure 5A:
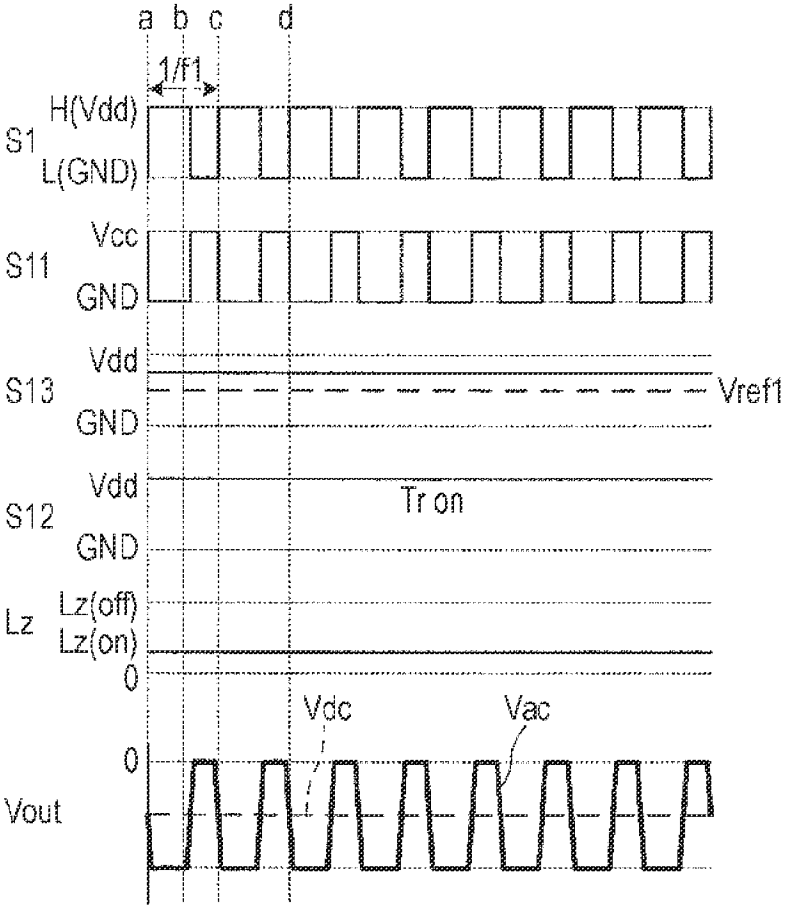

FIGS. 5A and 5B are timing charts illustrating the operations of the developing bias power supply source 18 of the second exemplary embodiment. More specifically, FIG. 5A illustrates the operation of the developing bias power supply source 18 when the AC setting signal S1 is a frequency f1, which is an example of a first frequency. FIG. 5B illustrates the operation of the developing bias power supply source 18 when the AC setting signal S1 is a frequency f2, which is an example of a second frequency. The frequency f2 is lower than the frequency f1.

As in FIGS. 3A and 3B, in FIGS. 5A and 5B, the AC setting signal S1, the switching signal S11, the changing signal S12, the inductance Lz of the primary winding T11 of the current control transformer 120, and the output voltage Vout are shown. In FIGS. 5A and 5B, the integration signal S13 is also shown.

The reference voltage Vref1 supplied to the – input terminal of the comparator 180 is a voltage obtained as a result of the integrating circuit 170 integrating the AC setting signal S1 having a duty ratio of 50%.

When the AC setting signal S1 shown in FIG. 5A is a high frequency, the duty ratio of the AC setting signal S1 is set to be higher than 50%. When the AC setting signal S1 shown in FIG. 5B is a low frequency, the duty ratio of the AC setting signal S1 is set to be lower than 50%. The other factors are similar to those of the first exemplary embodiment.

A description will first be given of the operation of the developing bias power supply source 18 when the AC setting signal S1 shown in FIG. 5A is a high frequency (frequency f1).

In a manner similar to the first exemplary embodiment, the switching signal S11 is generated in accordance with the AC setting signal S1. The voltage levels of the switching signal S11 are opposite to those of the AC setting signal S1.

The integrating circuit 170 outputs the integration signal S13 obtained by integrating the AC setting signal S1, which is a PWM signal. Since the duty ratio of the AC setting signal S1 is higher than 50%, the integration signal S13 is higher than the reference voltage Vref1. Accordingly, the changing signal S12 (the voltage of the base terminal of the npn transistor Tr of the drive circuit 140), which is the output of the comparator 180, is set to be the power supply voltage Vdd.

Then, the npn transistor Tr is turned ON, causing a current to flow through the secondary winding T12 of the current control transformer 120, thereby decreasing the inductance Lz of the primary winding T11 (setting the inductance of the primary winding T11 to be the inductance Lz (on)). As a result, a current flows through the output transformer 130 more easily.

With this arrangement, as in the first exemplary embodiment, in the second exemplary embodiment, when the AC setting signal S1 is a high frequency (frequency f1), the square (trapezoidal) waveform of the AC voltage Vac is maintained.

A description will now be given of the operation of the developing bias power supply source 18 when the AC setting signal S1 shown in FIG. 5B is a low frequency (frequency f2).

As in the high-frequency AC setting signal S1, the switching signal S11 is generated in accordance with the AC setting signal S1.

The integrating circuit 170 outputs the integration signal S13 obtained by integrating the AC setting signal S1, which is a PWM signal. Since the duty ratio of the AC setting signal S1 is lower than 50%, the integration signal S13 is lower than the reference voltage Vref1. Accordingly, the changing signal S12 (the voltage of the base terminal of the npn transistor Tr of the drive circuit 140), which is the output of the comparator 180, is set to be the ground voltage GND.

Then, the npn transistor Tr is turned OFF, and thus, a current does not flow through the secondary winding T12 of the current control transformer 120 so as to increase the inductance Lz of the primary winding T11 (set the inductance of the primary winding T11 to be the inductance Lz (off)), thereby making it difficult for the current to flow through the output transformer 130.

As in the first exemplary embodiment, it is possible to prevent an excessive current from flowing from the switching circuit 110 to the output transformer 130. It is also possible to inhibit the FET1 and the FET2 of the switching circuit 110 and/or the output transformer 130 from being heated.

As discussed above, in the second exemplary embodiment, the duty ratio of the AC setting signal S1 is set to be higher than 50% when the AC setting signal S1 is a high frequency, and the duty ratio of the AC setting signal S1 is set to be lower than 50% when the AC setting signal S1 is a low frequency. A determination is thus made whether the frequency of the AC setting signal S1 is a high frequency or a low frequency on the basis of the AC setting signal S1.

With this arrangement, in the second exemplary embodiment, the provision of the changeover switch 150 and the operation of the changeover switch 150 in the first exemplary embodiment are made unnecessary.

Additionally, since the frequency of the AC setting signal S1 is identified by the AC setting signal S1, a signal supplied from an external source to switch the inductance Lz is also made unnecessary.

The reference voltage Vref1 is a set on the basis of the AC setting signal S1 having a duty ratio of 50%. However, it is sufficient that the reference voltage Vref1 is set to be a voltage between the integration signal S13 when the AC setting signal S1 is a high frequency and the integration signal S13 when the AC setting signal S1 is a low frequency. Accordingly, it is not necessary that the duty ratio of the AC setting signal S1 be higher than 50% when the AC setting signal is a high frequency and that the duty ratio of the AC setting signal S1 be lower than 50% when the AC setting signal is a low frequency.

Third Exemplary Embodiment

In a third exemplary embodiment, in addition to the components of the developing bias power supply source 18 of the second exemplary embodiment, a differentiating circuit 190, which is an example of a differentiator, and a comparator 200, which is an example of a first comparator, are provided. With this configuration, the changing signal S12 can be set regardless of the duty ratio of the AC setting signal S1. The comparator 180 is also an example of a second comparator.

Hereinafter, portions similar to the second exemplary embodiment will be omitted, and portions different from the second exemplary embodiment will be described.

Configuration of Developing Bias Power Supply Source 18

Figure 6:
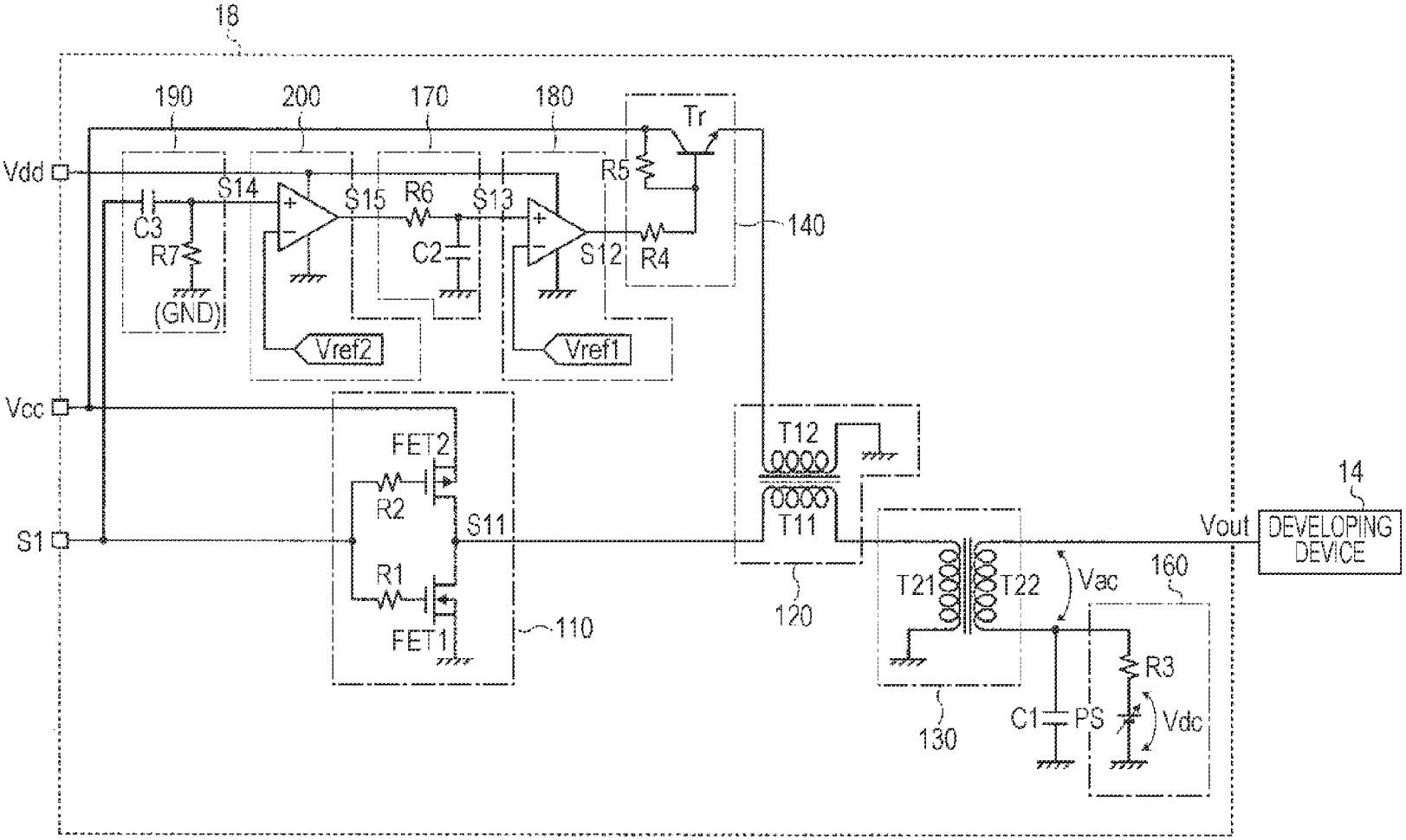
FIG. 6 illustrates an example of a developing bias power supply source of a third exemplary embodiment.

FIG. 6 illustrates an example of the developing bias power supply source 18 of the third exemplary embodiment.

The differentiating circuit 190 and the comparator 200 provided in addition to the components of the developing bias power supply source 18 of the second exemplary embodiment will be principally discussed. Portions similar to those of the first and second exemplary embodiments are designated by like reference numerals, and an explanation thereof will thus be omitted.

Differentiating Circuit 190

The differentiating circuit 190 includes a capacitor C3 and a resistor R7.

One terminal of the capacitor C3 serves as the input terminal of the differentiating circuit 190, and receives the AC setting signal S1 from the controller 40. The other terminal of the capacitor C3 is connected to one terminal of the resistor R7 and serves as the output terminal of the differentiating circuit 190. The other terminal of the resistor R7 is grounded (ground voltage GND). The output terminal of the differentiating circuit 190 is connected to the comparator 200.

The differentiating circuit 190 differentiates the AC setting signal S1, which is a PWM signal, and outputs a differentiation signal S14. The time constant t of the differentiating circuit 190 is determined by the product of the capacitor C3 and the resistor R7 (C3×R7).

Comparator 200

The configuration of the comparator 200 is similar to that of the comparator 180. The + input terminal of the comparator 200 is connected to the output terminal of the differentiating circuit 190, and a reference voltage Vref2, which is an example of a first reference voltage, is supplied to the − input terminal. The output terminal of the comparator 200 is connected to one terminal of the resistor R6 of the integrating circuit 170.

A power supply voltage Vdd (5 V) and a ground voltage GND (0 V) are supplied to the comparator 200.

The comparator 200 compares the differentiation signal S14 output from the differentiating circuit 190 with the reference voltage Vref2, and outputs an output signal S15 from the output terminal. The output signal S15 is set to be the power supply voltage Vdd when the voltage of the differentiating circuit S14 is equal to or higher than the reference voltage Vref2, and the output signal S15 is set to be the ground voltage GND when the voltage of the differentiating circuit S14 is lower than the reference voltage Vref2. The output signal S15 is a PWM signal.

The integrating circuit 170 smoothes (integrates) the output signal S15 and outputs the resulting integration signal S13.

Operation of Developing Bias Power Supply Source 18

Figure 7B:
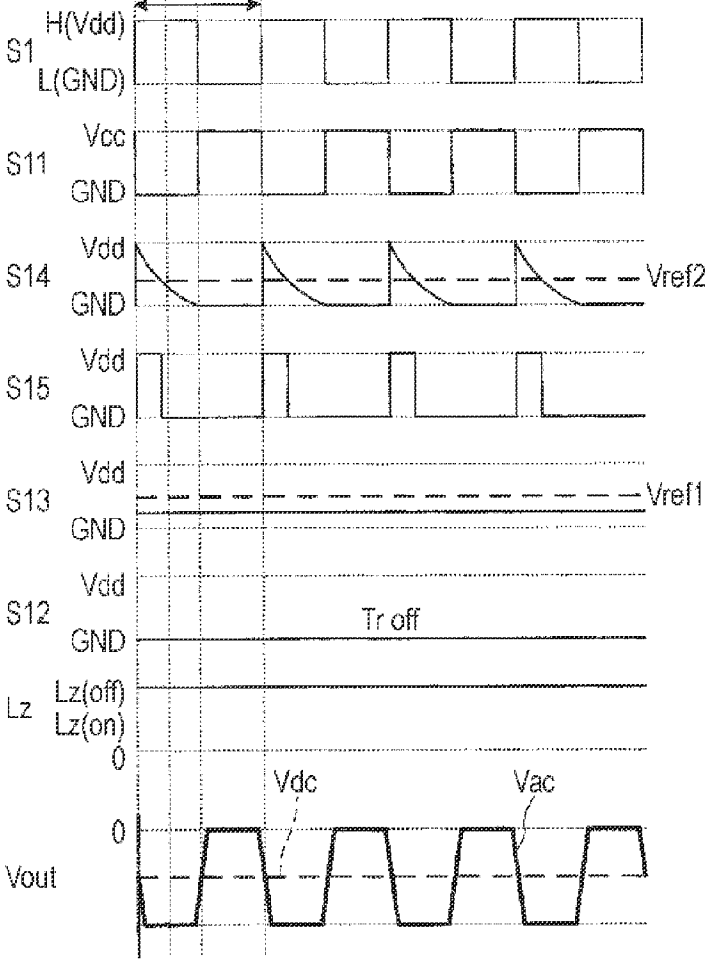
FIGS. 7A and 7B are timing charts illustrating operations of a developing bias power supply source of the third exemplary embodiment.
Figure 7A:
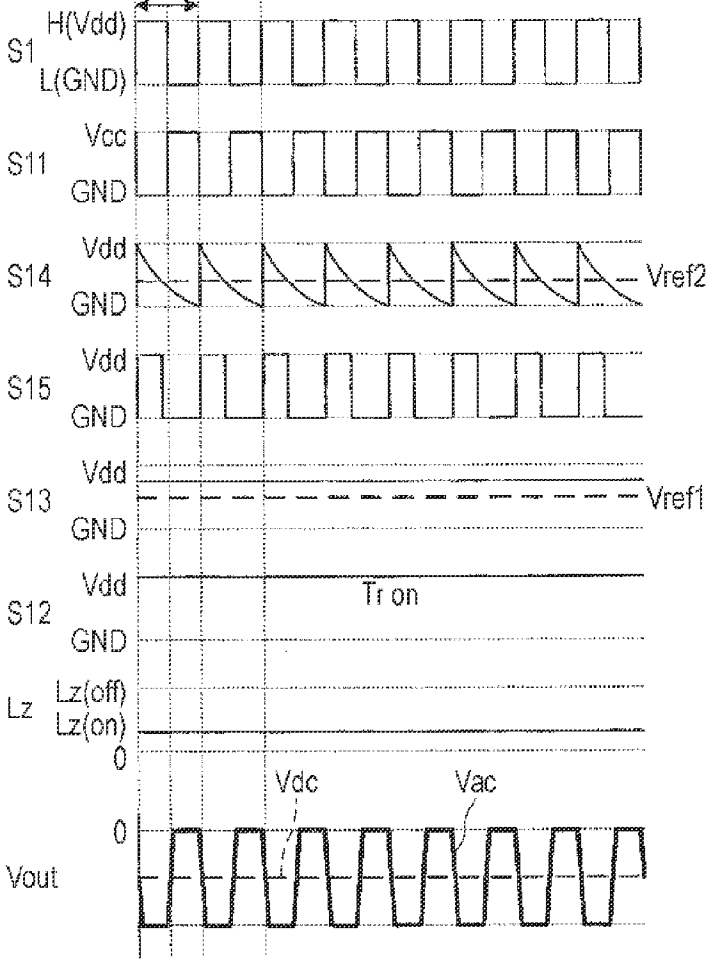

FIGS. 7A and 7B are timing charts illustrating the operations of the developing bias power supply source 18 of the third exemplary embodiment. More specifically, FIG. 7A illustrates the operation of the developing bias power supply source 18 when the AC setting signal S1 is a high frequency (frequency f1). FIG. 7B illustrates the operation of the developing bias power supply source 18 when the AC setting signal S1 is a low frequency (frequency f2 lower than frequency f1).

As in FIGS. 5A and 5B, in FIGS. 7A and 7B, the AC setting signal S1, the switching signal S11, the integration signal S13, the changing signal S12, the inductance Lz of the primary winding T11 of the current control transformer 120, and the output voltage Vout are shown. In FIGS. 7A and 7B, the differentiation signal S14 and the output signal S15 are also shown.

Unlike FIGS. 5A and 5B, in FIGS. 7A and 7B, the duty ratio of the AC setting signal S1 is 50%.

A description will first be given of the operation of the developing bias power supply source 18 when the AC setting signal S1 shown in FIG. 7A is a high frequency (frequency f1).

In a manner similar to the first and second exemplary embodiments, the switching signal S11 is generated in accordance with the AC setting signal S1.

The differentiating circuit 190 outputs the differentiation signal S14 obtained by differentiating the AC setting signal S1, which is a PWM signal. The differentiation signal S14 sharply shifts to the power supply voltage Vdd at the time when the AC setting signal S1 shifts from "L" (0 V) to "H" (5 V) (e.g., time a in FIG. 7A), and then attenuates in accordance with the time constant τ.

Then, the comparator 200 compares the differentiation signal S14 with the reference voltage Vref2 (e.g., 3 V) and generates the output signal S15. The output signal S15 is set to be the power supply voltage Vdd when the differentiation signal S14 is equal to or higher than the reference voltage Vref2, and the output signal S15 is set to be the ground voltage GND when the differentiation signal S14 is lower than the reference voltage Vref2. That is, the output signal S15 is a PWM signal.

Subsequently, the integrating circuit 170 integrates the output signal S15 and outputs the integration signal S13.

Then, as in the second exemplary embodiment, the comparator 180 compares the integration signal S13 with the reference voltage Vref1, which is an example of a second reference voltage.

The reference voltage Vref1 is set in advance so that the output signal S15 may become higher than the reference voltage Vref1 when the AC setting signal S1 is a high frequency.

With this setting, the changing signal S12 (the voltage of the base terminal of the npn transistor Tr of the drive circuit 140), which is the output of the comparator 180, is set to be the power supply voltage Vdd. Then, the npn transistor Tr is turned ON, causing a current to flow through the secondary winding T12 of the current control transformer 120, thereby decreasing the inductance Lz of the primary winding T11 (setting the inductance of the primary winding T11 to be the inductance Lz (on)). As a result, a current flows through the output transformer 130 more easily.

With this arrangement, as in the first and second exemplary embodiments, in the third exemplary embodiment, when the AC setting signal S1 is a high frequency (frequency f1), the square (trapezoidal) waveform of the AC voltage Vac is maintained.

A description will now be given of the operation of the developing bias power supply source 18 when the AC setting signal S1 shown in FIG. 7B is a low frequency (frequency f2).

As in the high-frequency AC setting signal S1, the switching signal S11 is generated in accordance with the AC setting signal S1.

The differentiating circuit 190 outputs the differentiation signal S14 obtained by differentiating the AC setting signal S1, which is a PWM signal. In this case, the time constant τ (C3×R7) of the differentiating circuit 190 is the same as that when the AC setting signal S1 is a high frequency. Thus, the differentiation signal S14 sharply shifts to the power supply voltage Vdd at the time when the AC setting signal S1 shifts from "L" (0 V) to "H" (5 V) (e.g., time a in FIG. 7B), and then attenuates with the time constant τ.

That is, the waveform of the differentiation signal S14 from time a to time c in FIG. 7B is similar to that from time a to time c when the AC setting signal S1 is a high frequency (FIG. 7A).

However, in contrast to the differentiation signal S14 shown in FIG. 7A in which the waveform from time a to time c is simply repeated as the waveform from time c to time d, the waveform from time a to time c is not repeated as the waveform from time c to time d.

Then, the comparator 200 compares the differentiation signal S14 with the reference voltage Vref2 (e.g., 3 V) and outputs the output signal S15, which is a PWM signal. The output signal S15 is set to be the power supply voltage Vdd when the differentiation signal S14 is equal to or higher than the reference voltage Vref2, and the output signal S15 is set to be the ground voltage GND when the differentiation signal S14 is lower than the reference voltage Vref2. Subsequently, the integrating circuit 170 integrates the output signal S15 and outputs the integration signal S13.

As in the output signal S15 in FIG. 7A, for part of the duration from time a to time c, the output signal S15 in FIG. 7B is set to be the power supply voltage Vdd. However, for the duration from time c to time d, the output signal S15 in FIG. 7B is not set to be the power supply voltage Vdd, in contrast to the output signal S15 in FIG. 7A. Accordingly, the voltage of the integration signal S13 output from the integrating circuit 170 is lower than that in FIG. 7A.

Thus, the reference voltage Vref1 which is compared with the integration signal S13 by the comparator 180 is set to be higher than the integration signal S13 shown in FIG. 7B. Then, the changing signal S12 (the voltage of the base terminal of the npn transistor Tr of the drive circuit 140), which is the output of the comparator 180, is set to be the ground voltage GND.

Then, the npn transistor Tr is turned OFF, and thus, a current does not flow through the secondary winding T12 of the current control transformer 120 so as to increase the inductance Lz of the primary winding T11 (set the inductance of the primary winding T11 to be the inductance Lz (off)), thereby making it difficult for the current to flow through the output transformer 130.

As in the first and second exemplary embodiments, it is possible to prevent an excessive current from flowing from the switching circuit 110 to the output transformer 130. It is also possible to inhibit the FET1 and the FET2 of the switching circuit 110 and/or the output transformer 130 from being heated.

As discussed above, the developing bias power supply source 18 of the third exemplary embodiment includes the differentiating circuit 190 and the comparator 200, and the AC setting signal S1 is differentiated by using the differentiating circuit 190. Then, by detecting the timing at which the AC setting signal S shifts (rises) from "L" to "H", a determination is made whether the AC setting signal S1 is a high frequency or a low frequency.

As the frequency of the AC setting signal S1 is higher, there are a greater number of rising edges per unit time. The falling edges of the differentiation signal S14 is set by the time constant τ of the differentiating circuit 190. Thus, the output signal S15 output from the comparator 200 is a pulse signal having a period determined by the time constant τ. As the frequency of the AC setting signal S1 is higher, there are a greater number of pulses of the output signal S15 per unit time, and thus, the voltage of the integration signal S13 output from the integrating circuit 170 becomes higher.

Accordingly, the reference voltage Vref1 can be set between the voltage of the integration signal S13 when the AC setting signal S1 is a high frequency and the voltage of the integration signal S13 when the AC setting signal S1 is a low frequency.

Additionally, restrictions imposed on the duty ratio of the AC setting signal S1 are decreased.

As discussed above, in the third exemplary embodiment, the provision of the changeover switch 150 and the operation of the changeover switch 150 are made unnecessary. Additionally, a determination is made whether the frequency of the AC setting signal S1 is a high frequency or a low frequency on the basis of the AC setting signal S1. Accordingly, a control circuit and a signal line for informing the frequency of the AC setting signal S1 are not necessary.

Additionally, restrictions imposed on the duty ratio of the AC setting signal S1, which is a PWM signal, are decreased.

In the first through third exemplary embodiments, a current flowing from the switching circuit 110 to the output transformer 130 is limited by the current control transformer 120.

Instead of the current control transformer 120, another circuit may be used. In short, any type of circuit may be used as long as a current flowing from the switching circuit 110 to the output transformer 130 can be limited in accordance with the frequency of the AC setting signal S1.

The high frequency (frequency f1) and the low frequency (frequency f2) and the values of the impedance (inductance Lz) set for the high and low frequencies in the first through third exemplary embodiments may be set on the basis of the waveform of the AC voltage supplied from a bias power supply (developing bias power supply source 18) to a load and on the basis of a current flowing through the bias power supply (developing bias power supply source 18).

In the first through third exemplary embodiments, the image forming apparatus 1 is of a tandem type, and the developing bias power supply source 18 is connected to each of the developing devices 14 corresponding to associated colors, such as Y, M, C, and K. However, one developing bias power supply source 18 may be connected to all the developing devices 14.

The developing bias power supply source 18 may be used for a multiple-rotary-type image forming apparatus including a rotary developing device to which plural developing units 14Y, 14M, 14C, and 14K storing toners of associated colors, such as Y, M, C, and K, are rotatably attached.

In the first through third exemplary embodiments, negative charging type toner is used. However, positive charging type toner may be used, instead. In this case, the polarity of the DC voltage Vdc of the bias power supply (developing bias power supply source 18) is set to be opposite to the polarity set in the first through third exemplary embodiments.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier;

a charging unit that charges the image carrier;

an exposure unit that exposes the image carrier charged by the charging unit to light and that forms an electrostatic latent image on the image carrier;

a developing unit that generates a developing electric field in which an alternating current voltage and a direct current voltage are superposed on each other and that develops the electrostatic latent image formed on the image carrier so as to form a developed image;

a transfer unit that transfers the developed image onto a transfer subject; and a controller that outputs an alternating current setting signal for setting a frequency of the alternating current voltage of the developing electric field generated by the developing unit, the developing unit including a bias power supply source, the bias power supply source including:

an output transformer including a primary winding and a secondary winding, the alternating current voltage being output from the secondary winding;

a switching circuit that supplies a current to the primary winding of the output transformer by performing switching on the basis of the alternating current setting signal output from the controller; and a current control circuit disposed between the primary winding of the output transformer and the switching circuit and including first impedance and second impedance, the second impedance being greater than the first impedance, wherein the first impedance is set when the frequency of the alternating current voltage is a first frequency and the second impedance is set when the frequency of the alternating current voltage is a second frequency, the second frequency being lower than the first frequency, thereby controlling a current flowing between the primary winding of the output transformer and the switching circuit, wherein the current control circuit includes a current control transformer having a primary winding that is connected to the primary windino of the output transformer.

2. The image forming apparatus according to claim 1, wherein the current control circuit includes an input that is connected to the switching circuit and an output that is connected to the primary winding of the output transformer.

3. A bias power supply apparatus comprising:

an output transformer that includes a primary winding and a secondary winding and outputs an alternating current voltage to a load connected to the secondary winding;

a switching unit that supplies a current to the primary winding of the output transformer by performing switching on the basis of an alternating current setting signal for setting a frequency of the alternating current voltage; and a current controller that is disposed between the primary winding of the output transformer and the switching unit and has first impedance and second impedance, the second impedance being greater than the first impedance, wherein the first impedance is set when the frequency of the alternating current voltage is a first frequency and the second impedance is set when the frequency of the alternating current voltage is a second frequency, the second frequency being lower than the first frequency, thereby controlling a current flowing between the primary winding of the output transformer and the switching unit, wherein the current controller includes a current control transformer haying a primary winding and a secondary winding, and connects the primary winding of the output transformer and the switching unit via the primary winding of the current control transformer, and controls inductance of the primary winding of the current control transformer by using a current flowing through the secondary winding of the current control transformer, thereby setting the first impedance and the second impedance.

4. The bias power supply apparatus according to claim 3, further comprising:

a driving unit that drives the current controller by supplying a current to the secondary winding of the current control transformer.

5. The bias power supply apparatus according to claim 4, further comprising:

an integrator that receives the alternating current setting signal and integrates the received alternating current setting signal; and a comparator that compares a voltage of the integrated alternating current setting signal with a predetermined reference voltage and controls the driving unit on the basis of a comparison result.

6. The bias power supply apparatus according to claim 4, further comprising:

a differentiator that receives the alternating current setting signal and differentiates the received alternating current setting signal;

a first comparator that compares a voltage of the differentiated alternating current setting signal with a predetermined first reference signal and generates a pulse-width-modulated signal;

an integrator that receives the pulse-width-modulated signal and integrates the received pulse-width-modulated signal; and a second comparator that compares a voltage of the integrated pulse-width-modulated signal with a predetermined second reference voltage and controls the driving unit on the basis of a comparison result.

7. The bias power supply apparatus according to claim 3, wherein the current controller includes an input that is connected to the switching unit and an output that is connected to the primary winding of the output transformer.

8. A bias power supply method comprising:

outputting an alternating current voltage to a load connected to a secondary winding of an output transformer;

supplying a current to a primary winding of the output transformer by performing switching on the basis of an alternating current setting signal for setting a frequency of the alternating current voltage;

setting a first impedance when the frequency of the alternating current voltage is a first frequency and setting a second impedance when the frequency of the alternating current voltage is a second frequency, the second frequency being lower than the first frequency, the second impedance being greater than the first impedance, thereby controlling a current flowing between the primary winding of the output transformer and a switching unit; and controlling an inductance of a primary winding of a current control transformer by using a current flowing through a secondary winding of the current control transformer, thereby setting the first impedance and the second impedance, the primary winding of the current control transformer connecting the primary winding of the output transformer and the switching unit.

* * * * *